US005491459A

United States Patent [19]

Leupold

[11] Patent Number: 5,491,459

[45] Date of Patent: Feb. 13, 1996

[54] MAGIC SPHERE PROVIDING DISTORTION-FREE ACCESS TO A LARGE INTERNAL WORKING SPACE CONTAINING A UNIFORM HIGH-INTENSITY MAGNETIC FIELD

[75] Inventor: Herbert A. Leupold, Eatontown, N.J.

[73] Assignee: The United States of America as represented by the Secretary of the Army, Washington, D.C.

[21] Appl. No.: 494,614

[22] Filed: Jun. 23, 1995

[51] Int. Cl.[6] ..... H01F 7/02

[52] U.S. Cl. ..... 335/306; 335/210; 315/5.35

[58] Field of Search ..... 335/210, 296–306; 315/5.34, 5.35; 250/396 ML

[56] References Cited

U.S. PATENT DOCUMENTS

| | | | |
|---|---|---|---|
| 4,837,542 | 6/1989 | Leupold | 335/306 |
| 5,216,401 | 6/1993 | Leupold | 335/306 |
| 5,382,936 | 1/1995 | Leupold et al. | 335/306 |
| 5,396,209 | 3/1995 | Leupold | 335/306 |

*Primary Examiner*—Leo P. Picard
*Assistant Examiner*—Raymond M. Barrera
*Attorney, Agent, or Firm*—Michael Zelenka; James A. Digiorgio

[57] ABSTRACT

A magic sphere that provides a uniform internal field within an enlarged working space that can be accessed from large chambers that penetrate deep into the cavity of the magic sphere without substantially disrupting the magnitude or uniformity of the internal field.

9 Claims, 1 Drawing Sheet

MAGIC SPHERE PROVIDING DISTORTION-FREE ACCESS TO A LARGE INTERNAL WORKING SPACE CONTAINING A UNIFORM HIGH-INTENSITY MAGNETIC FIELD

GOVERNMENT INTEREST

The invention described herein may be manufactured, used, and licensed by or for the Government for governmental purposes without the payment to me of any royalties thereon.

FIELD OF INVENTION

The invention relates to high-field permanent magnets. More specifically, this invention relates to permanent magnet structures that provide internal uniform magnetic fields that can be accessed through non-distorting access ports

BACKGROUND OF THE INVENTION

One of the most critical problems confronting designers of high-intensity internal magnetic field sources has been accessing the internal field without distorting it. More specifically, those skilled in the art know that drilling an access port in the shell of a magnetic structure that produces an internal field, such as a magic sphere, can significantly distort the uniformity of that internal field.

Heretofore, several permanent magnet structures have been designed to provide distortion free access to an internal uniform magnetic field. The following references, which are hereby incorporated herein, show many types of magnetic structures that can be utilized for such purposes: (1) Pat. No. 5,396,209 entitled "Light-Weight Magnetic Field Sources Having Distortion-Free Access Ports," issued Mar. 7, 1995, to Leupold; (2) Pat. No. 5,216,401, entitled "Magnetic Field Sources Having Non-Distorting Access Ports," issued Jun. 1, 1993, to Leupold; (3) Pat. No 4,837,542, entitled "Hollow Substantially Hemispherical Permanent Magnet High-Field Flux Source For Producing A Uniform High Field," issued Jun. 6, 1989, to Leupold.

These reference patents describe different techniques for altering the magnetization of permanent magnet shells which generate a uniform field in an internal cavity such that a portion of the shell could be removed to access the internal field, from outside the entire structure, without disrupting the uniformity of that internal field. As described in the patents referenced above, such shell altering techniques can be performed on shells having many different sizes and shapes. Of particular significance are those structures having a spherical shell of a cylindrical shell. When the shell of such spherical and cylindrical structures are altered so that access ports can be drilled through the magnetic poles or the equator of the shell, the resultant structures are called magic spheres and magic rings, respectively. See, Pat. No. 5,216,401, and Pat. No. 4,837,542.

Briefly, a magic sphere is a magnetic structure having a spherically-shaped permanent magnet shell wherein the shell has a predetermined thickness and a magnetization that varies as a function of the polar angle around the shell. Similarly, a magic ring has a ring-shaped permanent magnet shell that has a predetermined thickness and magnetization that varies as a function of the polar angle around the shell. As disclosed, the magnitude of the internal magnetic field directly depends on the thickness and the magnetization of the shell. Thus, depending on the size and magnetization of the shell material, an artisan could design a structure proving an internal field over a wide range of magnetization, wherein that field could be access from outside the shell through ports drilled in predetermined locations in the material.

It has been shown, however, that although these shell-altering techniques provide distortion-free access to the internal field, the resultant internal field is substantially weaker than the that of an un-altered structure of the same size. Accordingly, the inventor herein developed a method of increasing the strength of the internal field without distorting the uniformity of the internal field. See Pat. No. 5,382,936, entitled "Field Augmented Permanent Magnet Structures," issued to Leupold et al., on Jan. 17, 1995, incorporated herein by reference.

As shown, by placing permanent magnets and/or passive ferromagnets in predetermined locations within the internal chamber of the shell, a higher internal field could be achieved with less shell material. As a result, these field-augmented permanent magnet structures became highly desirable to those having a premium on space.

These structures as well as all other permanent magnet high field sources, however, presented several problems to the user. More specifically, due to the small and narrow shape of the access ports through the shell of the structure, access to the internal working field must be from outside the entire structure itself. In addition, if the internal cavity contained field-augmenting magnets or passive ferromagnets, the size of the internal cavity is also very small and narrow. As a result, the structure was not very useful for most applications wherein space is at a premium and wherein a large internal work space is needed to house the uniform internal field.

SUMMARY OF THE INVENTION

Accordingly, an object of the present invention is to provide a permanent magnet structure that generates an augmented uniform internal magnetic working field in a large working cavity or space that can be accessed through large access ports that extend through the shell into the internal cavity of the shell so that electrical components and other devices can extend into the structure to communicate with the internal working field. To attain this, the present invention provides a magic sphere structure having an internal cavity that contains a field augmenting permanent magnet and a pair of passive ferromagnet caps that form a large working space within the internal cavity of the shell.

In general, once the required size of the working space within the internal cavity is determined, the remaining cavity space is filled with a field augmenting permanent magnet and passive ferromagnet material to smooth-out the magnetic flux distribution in the working space. More specifically, the permanent magnet insert fills the area of the internal cavity adjacent to the inner surface of the spherical shell around the entire circumference of the equatorial axis of the shell such that it outlines the equatorial limits of the desired working space within the internal cavity. The passive ferromagnet material then fills the remaining space in the internal cavity, adjacent to each magnetic pole of the magic sphere shell. As a result, the passive ferromagnets act as caps on the space outlined by the permanent magnet insert to form the enlarged working space containing the internal field.

This cavity configuration allows for large holes to be drilled in the shell material at the magnetic poles of the structure without significantly disrupting the uniformity and strength of the internal working field. More specifically, the passive ferromagnet caps smooth-out any non-uniformities caused by the large access holes, and the permanent magnet insert compensates for any field loss due to the large access holes. Thus, the uniformity and strength of the internal field can only be maintained if the large access ports do not extend into the magic sphere beyond the passive ferromagnet caps. As a result, the port communicating between the access holes and the internal working space must be small.

Given the requirements for the internal field strength, the working space size and the size of the access ports, one skilled in the art can determine the optimal size, shape and magnetization of the field-augmenting permanent magnet insert and the field-smoothing passive ferromagnet or iron. Thus, the structure as described herein overcomes to a large extent the limitations of the prior-art.

These and other features of the invention are described in more complete detail in the following description of the preferred embodiment when taken with the drawings. The scope of the invention, however, is limited only by the claims appended hereto.

DETAILED DESCRIPTION OF THE INVENTION

Figure 1:
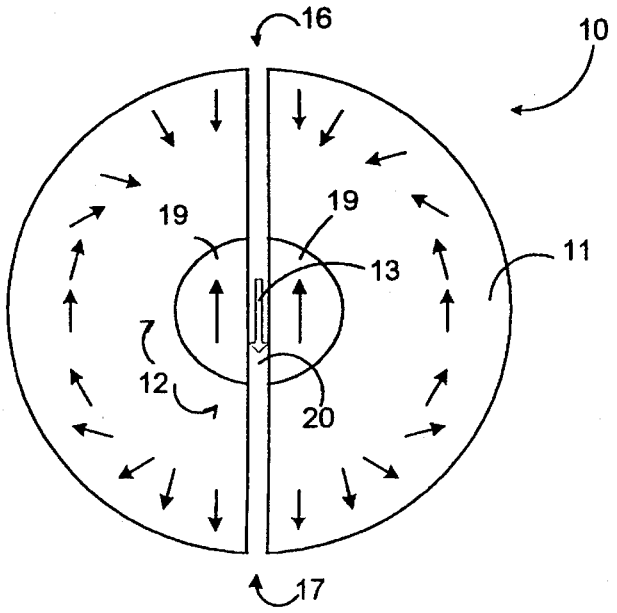
Fig. 1 (PRIOR ART)
FIG. 1 is a cross-sectional view of a prior-art magic sphere providing limited access to an augmented uniform magnetic field within small working space.

Referring now to FIG. 1 there is shown a cross-sectional view of prior art magic sphere 10. Magic sphere 10 is composed of a spherical shell 11 that forms spherical internal cavity 12 within which shell 11 generates uniform magnetic field 13. Permanent magnet insert 19 is magnetized in a direction opposite to that of internal field 13 and positioned within internal cavity 12 such that it enhances the strength of internal field 13 and compensates for any internal field 13 loss due to the removal of shell material to form access ports 16 and 17.

As shown in FIG. 1, insert 19 utilizes a large portion of the available space within cavity 12. The remaining space is called the working space 20. Since working space 20 as well as access ports 16 and 17 are very narrow and limited in shape, sphere 10 has very limited application. Not only does sphere 10 limit the size of the usable working space 20 within internal cavity 12, it also limits access to internal field 13 contained therein such that the structure is useful for a limited number of applications. For example, to utilize internal field 13 to accelerate electrons or focus an electron beam, an electron gun would have to be positioned at the exterior of the entire sphere itself. As a result, the gun must not only be able to shoot an electron beam through narrow access ports 16 and 17, it must require only a limited amount of working field area for its application. This is very undesirable for most applications.

Figure 2:
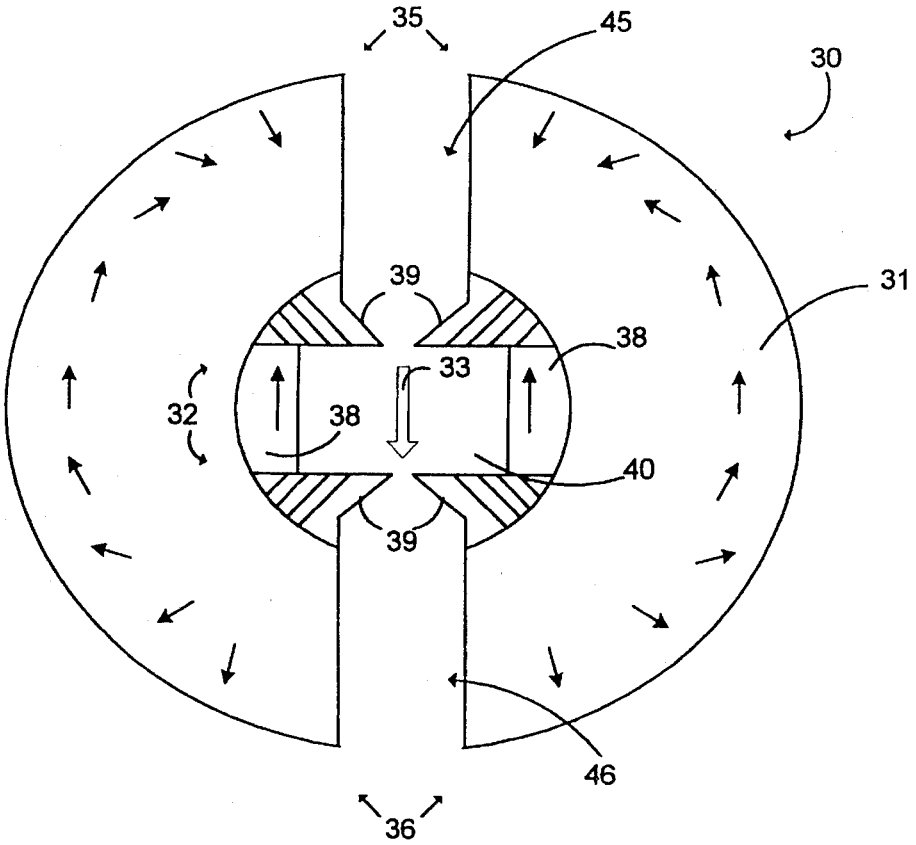
FIG. 2 is a cross sectional view of an embodiment of the invention providing large access ports to an augmented uniform magnetic field within a large internal working space without significantly distorting the uniformity or reducing the strength of the internal field.

Referring now to FIG. 2 there is shown a cross-section view of one embodiment of the invention, magic sphere 30. As shown, magic sphere 30 has a spherical permanent magnet shell or shell 31 which forms internal spherical cavity or cavity 32 within which it generates uniform internal magnetic field or internal field 33 in a direction between polar regions 35 and 36 of shell 31. Internal field 33 can be accessed through access ports 45 and 46.

As shown, cavity 32 contains permanent magnet insert 38 and passive ferromagnet caps or iron caps 39 which are positioned in relation to each other to form working space 40 within cavity 32. Insert 38 is magnetized in a direction opposite to that of internal field 33 such that insert 38 enhances internal field 33 and compensates for internal field loss due to access ports 45 and 46. Iron caps 39 are magnetized by shell 31 and act to smooth out any non-uniformity of internal field 33 that may be cause by port 45 and 46.

An important feature to note is the small opening between access port 45 and working space 40 as well as between access port 46 and working space 40. These small openings insure and protect the uniformity of internal field 33 by limiting any distorting effect these holes may have on internal field 33. Thus, access ports 45 and 46 can be enlarged to accommodate a device like an electron gun without significantly distorting internal field 33.

In operation, an electron gun can be place in access port 45 and a collector in port 46 such that an electron beam can be accelerated through working space 40 for many applications. As a result, less space is needed surrounding sphere 30 and more working area is available for the application.

Consequently, resultant sphere 30 provides a much larger working space and much larger access ports than the prior art without compromising internal field strength or uniformity. Thus, overcoming to a large extent the limitations associated with the prior art.

What is claimed is:

1. A magic sphere for providing a large internal working space containing a uniform magnetic field, comprising:

a spherical permanent magnet shell for generating the uniform magnetic field, said shell forming an internal cavity, said shell having a predetermined thickness, an inner and an outer surface, a pair of magnetic poles forming a polar axis along which the uniform magnet field is directed, and an equatorial axis transverse to said polar axis;

a permanent magnet insert for enhancing the magnitude of the internal field, said permanent magnet insert positioned in said internal cavity adjacent to said inner surface of said shell along the circumference of said equatorial axis of said shell, said permanent magnet insert magnetized in a direction opposite to said polar axis; and a pair of passive ferromagnet caps for smoothing out any non-uniformity in the internal field, said passive caps positioned in said internal cavity at opposite ends of said polar axis adjacent to said magnetic poles of said shell such that said permanent magnet insert is positioned therebetween, said permanent magnet insert and said passive caps forming the large internal working space within said internal cavity.

2. The magic sphere of claim 1 wherein the internal working space has a cylindrical shape.

3. The magic sphere of claim 2 wherein said cylindrical working space has a predetermined diameter and a predetermined height.

4. The magic sphere of claim 3 wherein said diameter and said height of the working space are substantially the same size.

5. The magic sphere of claim 1 wherein said passive ferromagnet caps are made of iron.

6. The magic sphere of claim 1 wherein said permanent magnet shell has a large access hole drilled through each of said magnetic poles without disrupting the uniformity of the internal uniform magnetic field in the working space.

7. The magic sphere of claim 6 wherein said access holes extend into said passive caps.

8. The magic sphere of claim 7 wherein each said passive cap has an access port communicating between said access holes and the working space.

9. The magic sphere of claim 8 wherein an electron gun is placed in one of said access holes and a collector within the other said access hole such that an electron gun can fire an electron beam from one access hole to the other through the working space.

* * * * *